US008696457B2

(12) United States Patent
Tsuchida et al.

(10) Patent No.: US 8,696,457 B2
(45) Date of Patent: Apr. 15, 2014

(54) GAME SOUND FIELD CREATOR

(75) Inventors: Yoshinori Tsuchida, Tokyo (JP); Minoru Tsuchihashi, Tokyo (JP)

(73) Assignee: Square Enix Co., Ltd., Tokyo (JP)

( * ) Notice: Subject to any disclaimer, the term of this patent is extended or adjusted under 35 U.S.C. 154(b) by 0 days.

(21) Appl. No.: 13/447,384

(22) Filed: Apr. 16, 2012

(65) Prior Publication Data

US 2012/0315988 A1 Dec. 13, 2012

(30) Foreign Application Priority Data

Jun. 10, 2011 (JP) ..... 2011-129941

(51) Int. Cl.
*A63F 9/24* (2006.01)

(52) U.S. Cl.
USPC ..... 463/35; 381/306; 381/307

(58) Field of Classification Search
USPC ..... 463/35; 381/306, 307
See application file for complete search history.

(56) References Cited

U.S. PATENT DOCUMENTS

| | | | | |
|---|---|---|---|---|
| 5,633,993 | A * | 5/1997 | Redmann et al. | 345/419 |
| 7,167,567 | B1 * | 1/2007 | Sibbald et al. | 381/17 |
| 2004/0235545 | A1 * | 11/2004 | Landis | 463/9 |
| 2005/0179701 | A1 * | 8/2005 | Jahnke | 345/619 |
| 2007/0293313 | A1 * | 12/2007 | Shimizu et al. | 463/31 |
| 2009/0286600 | A1 * | 11/2009 | Hideya | 463/35 |
| 2010/0323793 | A1 * | 12/2010 | Andall | 463/35 |

FOREIGN PATENT DOCUMENTS

JP 2007-184792 7/2007

* cited by examiner

*Primary Examiner* — Steve Rowland
(74) *Attorney, Agent, or Firm* — Duane Morris LLP

(57) ABSTRACT

Game sound field creator is comprised of means for computing a spaced distance between a sound source and a player character, means for outputting sound track data to default speakers if the spaced distance is a first distance or shorter, means for stopping output of the sound track data if the spaced distance is a second distance or longer, means for computing a virtual development angle of each sound channel according to the spaced distance if the spaced distance is between the first distance and the second distance, means for converting a virtual development angle into an actual angle adding a direction of the sound source and means for reproducing the sound track data of each sound channel based upon the converted actual angle.

5 Claims, 3 Drawing Sheets

GAME SOUND FIELD CREATOR

CROSS REFERENCE TO RELATED APPLICATION

The present disclosure relates to subject matter contained in Japanese patent application No. 2011-129941 filed on Jun. 10, 2011, the disclosure of which is expressly incorporated herein by reference in its entirety.

TECHNICAL FIELD

This invention relates to a game sound field creator that creates a proper sound field between a sound field where sounds are reproduced from separate speakers on which two or more sound channels are set by default and a monaural sound field according to a distance between a sound source and a player character in a virtual space in a game.

BACKGROUND ART

In a conventional game sound field creator, a reality is improved in such a manner that a position or a direction of a virtual camera (player character) to the sound source is computed and volume of the sounds from the stereo speakers and its balance between right and left speakers are controlled so as to produce the sounds from a direction according to a position of the player character based upon a computed result (patent related document 1).

PRIOR ART

[Patent related document 1]: Japanese patent application publication No. 2007-184792

Problems to be Solved by Invention

In such a device, a form of reproducing of the sound channels comprising the sound field is not changed and the sounds of the respective sound channels are independently reproduced from the right and left speakers regardless of a distance between the player character and the sound source although the sound volume of the stereo channels and the balance between the right and the left speakers are changed according to the direction or the position of the player character with respect to the sound source.

If the player character is near the sound source, there is no problem in reproducing the sounds of the stereo channels from the right and left speakers. If the player character has separated from the sound source, a normal situation is that the sounds from the sound source where sound track data of sound channels are mixed is heard as monaural sounds from a direction where the sound source exists. In such a case, it is unnatural that the sounds of stereo channels are reproduced from right and left speakers as the sounds from separate sound channels. Such a thing remarkably occurs when signals of the sound source have many sound channels, such as surround rather in comparison with the stereo channels (two channels), and even if the player character leaves from the sound source, the sounds from the sound source are reproduced by surround, similar to a time when the player character approaches the sound source, and players easily have a feeling that something is wrong.

An object of the invention is to provide a game sound field creator that creates a proper sound field by changing the form of reproducing of two or more sound channels according to the distance between the sound source and the player character.

Means for Solving Problems

A first aspect of the invention is a game sound field creator in a game apparatus (1) with which speakers (10A, 10B, 10C, 10D) located at two or more positions can be connected, through which sound track data from a sound source (S) having two or more sound channels (S) that is located at predetermined positions in a virtual space (VS) formed in a memory space can be respectively outputted from the speakers in association with a position of a player character (PC) located in said memory space, said sound channel being set corresponding to a position where said each speaker is located, in said game apparatus, said player character can freely moved in said virtual space by a player through an input means (15), said game sound field creator comprising:

a distance computer (7) that computes a spaced distance (L1, L2, L3) between said sound source and said player character in said virtual space;

a direction computer that computes a direction ($\alpha$) of said sound source to said player character in said virtual space;

a distance judger (7) that judges as to whether said spaced distance is a first distance (r) or shorter, is a second distance (R) longer than the first distance or longer, or between the first distance and the second distance;

a first output means (6) that respectively outputs sound track data of said two or more sound channels to said speakers located at positions corresponding to said sound channels if said spaced distance (L1) is said first distance or shorter;

a second output means (6) that stops output of said sound track data of said two or more sound channels if said spaced distance (L3) is said second distance or longer;

a virtual development angle computer that computes a virtual development angle of said each sound channel corresponding to said spaced distance (L2) between a default development angle of said first distance and zero (0) degree of said second distance if said spaced distance (L2) is between said first distance and said second distance;

an actual angle converter (7) that converts said obtained virtual development angle of said each sound channel into an actual angle adding a direction of said sound source; and output assignment reproducer (6) that assigns said sound track data of each sound channel to one or more said speakers based upon said converted actual angle of said each sound channel and reproduces the assigned data.

A second aspect of the invention is the game sound field creator, wherein said speakers located at two or more positioned are a front right speaker (10A), a front left speaker (10B), and said sound track data of said sound source (S) are set for two channels in association with said front right speaker and said front left speaker.

A third aspect of the invention is the game sound field creator, wherein said speakers located at two or more positioned are the front right speaker (10A), the front left speaker (10B), a rear right speaker (10D) and a rear left speaker (10C), and said sound track data of said sound source (S) are set for four channels in association with said front right speaker, said front left speaker, said rear right speaker and said rear left speaker.

A fourth aspect of the invention is the game sound field creator, wherein said distance judger (7) has an area setter (7) that sets an original sound field area (OSF) where a radius from said sound source (S) is set to be a first distance (r) and a sound field converging area (OCR) where a radius from said sound source is set to be a second distance (R), and said distance judger judges whether said spaced distance is the first distance or shorter, the second distance longer than the first distance or longer, or between the first distance and the second distance by whether said player character is in said original sound field area or said sound field converging area.

A fifth aspect of the invention is the game sound field creator in the game apparatus, wherein said original sound field area is located inside said sound field converging area.

Effects of Invention

According to the first aspect of the invention, if the spaced distance between the player character (PC) and the sound source (S) is the first distance near the sound source or longer and the second distance where the output of the sound track data of the sound source is stopped or shorter, the virtual development angle computer and the actual angle converter control the reproduction of sounds such that the development angle of each sound channel of the sound source becomes 0° (monaural) for the direction of the sound source as the player character separates from the sound source. Therefore, as the player character PC separates from the sound source, each sound channel of the sound source that is firstly reproduced enclosing the periphery of the player character PC (surround reproduction) is gradually transferred from a surround reproduction state into a monaural reproduction state where the sound track data of all sound channels are mixed and heard from the direction of the sound source, having a directivity in the direction of the sound source that is seen from the player character, and lastly the reproduction of the sound source is stopped. When the player character PC approaches the sound source, firstly no sound is heard, and the sound track data of all sound channels are heard from the sound source direction at a time when the spaced distance is the second distance or shorter. When the player character further approaches the sound source, each sound channel is gradually distributed to the peripheral speakers based upon the development angle (actual angle) from the monaural state. When the spaced distance lastly becomes the first distance or shorter, the sound track data of each sound channel of the sound source is reproduced surrounding the periphery of the player character PC (surround reproduction). That is, it is possible to create natural and proper sound field through the change of reproduction forms of two or more sound channels according to the distance between the sound source and the player character.

According to the second and third aspects of the invention, the invention can be applied to a two channel stereo comprised of front right and front left speakers, and a four channels stereo comprised of the front right speaker (10A), the front left speaker (10B), the rear right speaker (10D) and the rear left speaker (10C).

According to the fourth aspect of the invention, control is simple since it is possible to use bounds where sound source volume is reproduced at the maximum volume (radius r) and the bounds showing audible bounds of sounds of the sound source (radius R), that are originally set in the game program GPR as they are.

The number in parentheses shows the corresponding element in the drawings for the sake of convenience, accordingly, the descriptions are not restricted and bound by the descriptions on the drawings.

PREFERRED EMBODIMENT

An embodiment of the invention is now explained, referring to appended drawings.

Figure 1:
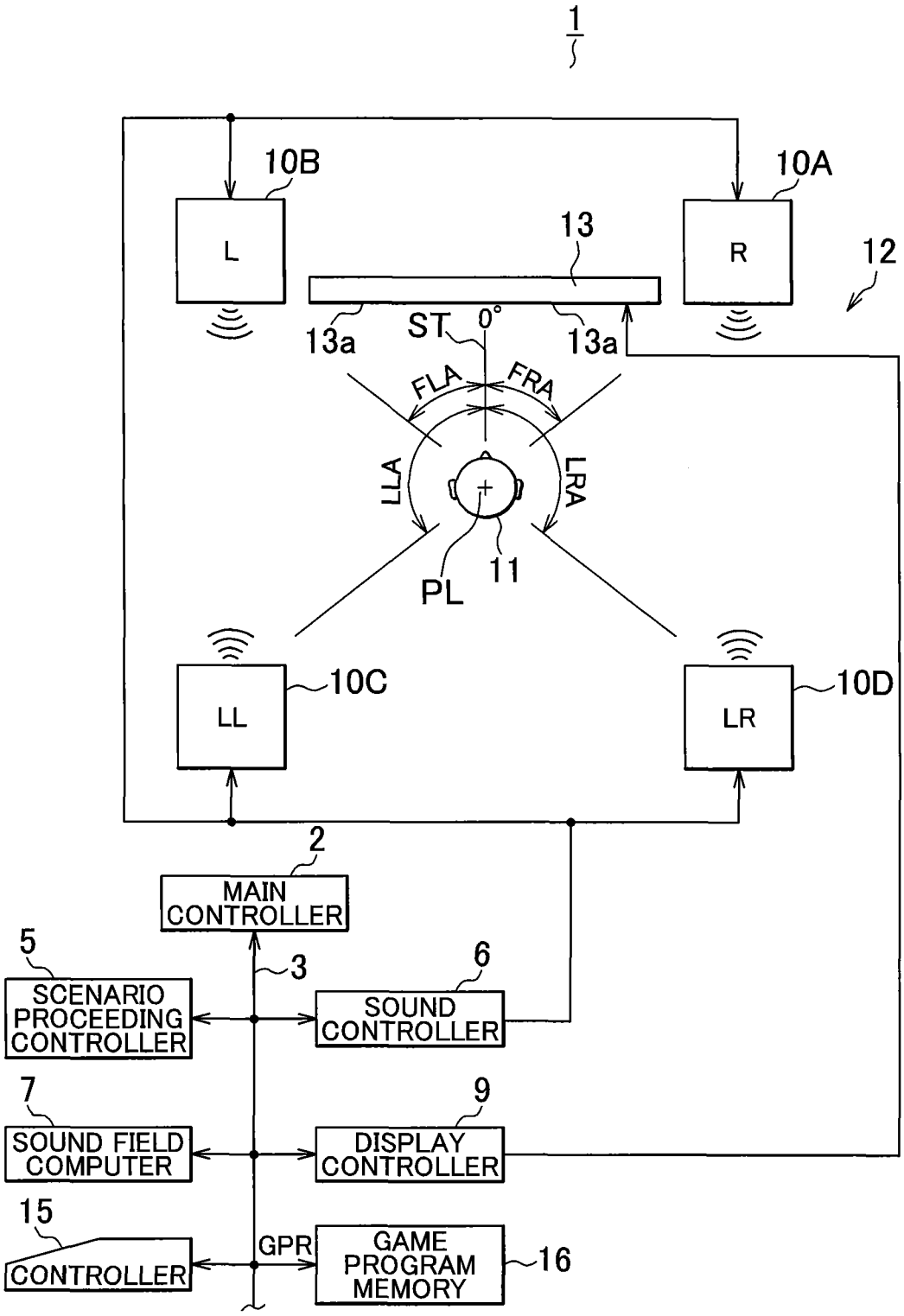
FIG. 1 is a block diagram of a game apparatus to which an embodiment of a game sound field creator of the invention is applied.

FIG. 1 shows a game apparatus 1 comprising a computer. As shown in FIG. 1, the game apparatus 1 has a main controller 2, and a scenario proceeding controller 5, a sound controller 6, a sound field computer 7, a display controller 9, a controller 15 as an input means, and a game program memory 16 that is comprised of a hard disc, a semiconductor memory and the like are connected with the main controller 2 via a bus line 3. A front right speaker 10A, a front left speaker 10B, a rear right speaker 10D and a rear left speaker 10*c* are connected with the sound controller 6. These four speakers are positioned locating on four apexes of a quadrangle (that may be a trapezoid as well as a square and a rectangle), and in a game program (not shown), the sound controller 6 is possible to reproduce sound track data assigned to four sound channels that are prepared by default dedicated for the respective speakers 10A, 10B, 10C and 10D and to supply the respective speakers 10A, 10B, 10C and 10D with the reproduced and to reproduce these sounds every each sound channel, being independent of each speaker 10 in a game program (not shown). By doing so, the speakers 10A, 10B, 10C and 10D structures a so-called surround system 12, and a player 11 that is positioned at a center being an almost equal distance away from the respective speakers 10A, 10B, 10C and 10D is possible to experience a sound field that is three-dimensional and has a reality by sounds from four sound channels outputted from these speakers 10A, 10B, 10C and 10D.

The respective speakers 10A, 10B, 10C and 10D of FIG. 1 are located at predetermined development angles based upon a base line ST in a pair of the front speakers 10A and 10B in a pair of the rear speakers 10C and 10D. In this case, such a baseline ST is a line vertical to a line segment connecting the right and left speakers 10A and 10B drawn from a supposed listening position PL of the player 11 spaced an equal distance of each speaker of each pair. In other words, development angle FRA (right 45°, for example) clockwise with respect to the baseline ST is set for the front right speaker 10A, and development angle FLA (left 45° degrees, for example) anticlockwise with respect to the base line ST is set for the front left speaker 10B, and development angle LLA (left 120° degrees, for example) anticlockwise with respect to the base line ST is set for the rear left speaker 10C and development angle LRA (right 120°, for example) clockwise with respect to the base line ST is set for the rear right speaker 10D. The arrangement of the respective speakers 10 or their set angles are exemplary, and may be widely changed according to a playing environment of each player. In order to easily understand the invention, a typical speaker arrangement and the development angles are positively set, but the change of such a speaker arrangement or such development angles do not affect an essence of the invention.

For the sound source S that is used in game program GPR, an arrangement form of speakers for general multi-channels, that is, the development angle of each sound channel of the sound source is adopted as a default value. In a case of a stereo arrangement of front right and left two channels, for example, two sound channels are set to the sound source S, and (the sound channel corresponding to) the front right speaker 10A is set with the development angle FRA (right 45°, for example) clockwise with respect to the base line ST, and (the sound source corresponding to) the front left speaker 10B is set with the development angle FLA (left 45°, for example) anticlockwise with respect to the standard line ST. In a case of an arrangement of four channels of the front speakers 10A and 10B and the rear speakers 10C and 10D, four sound channels are set by default for the sound source S, and the development angle of each speaker (sound channel) is set as the default value, similar to the speaker arrangement of FIG. 1.

Such development angles as the default values are not always the above-mentioned angles, but are optional. For example, the development angle LLA of (the sound channel corresponding to) the rear left speaker may be set with left 135°, and the development angle LRA of (the sound channel corresponding to) the rear right speaker may be set with right 135°. Of course, the actual development angle of each speaker used by the player is different from one of each speaker (sound channel) determined by the game program GPR. In this embodiment, a dedicated speaker for reproducing the sound channel is set as default for each sound channel, assuming that the actual development angle of each speaker on the player side corresponds with one of each speaker determined by the game program GPR. In other words, the front speakers 10A and 10B and the rear speakers 10C and 10D are set as the speakers dedicated for reproducing the sound channels by default for the respective sound channels. In this case, each speaker corresponding to each sound channel is referred to as a default speaker of the corresponding sound channel.

Number of the speakers comprising the surround system 12 and its arrangement form are optional. Then, number of such speakers may be five or more as well as four as shown in FIG. 1. And, the speaker system to which the invention is applied is not always the surround system, but may be a stereo system of the two channels that comprises the right and left speakers. Furthermore, two or more speakers through which two or more sound channels are respectively reproduced may be located and a sound field may be formed by such speakers.

A plane display 13 is connected with the display controller 9 such that a display surface 13*a* faces the player 11. In addition, various kinds of hardware, such as a hard disc, an optical disk I/O device, are connected with the game apparatus 1, but portions having no relation to the invention are not shown and the explanations thereof are not mentioned. Players can enjoy a predetermined game in the game apparatus 1 in such a manner that the main controller 2 advances and controls a predetermined scenario through the scenario proceeding controller 5 based upon a game program that is read out of an optical disk (not shown) or is downloaded via a communication line (not shown), such as the Internet, and is stored in the game program memory 16.

In the above-mentioned explanation, the computer in the invention through which the game program functions is the game apparatus 1 for domestic use, but may not be the machine dedicated for games. The game apparatus 1 may be an apparatus through which a general recording medium of music or images can be reproduced. Furthermore, any computer through which the game program can function, such as a personal computer and a mobile phone, is available.

A method of storing various kinds of programs comprising the game program GPR and various kinds of data including sound data is optional as long as these programs and data can be read out by program function of the game program GPR. As the present embodiment, these may be stored in the game program memory 16 together with the program of the game program GPR, or these may be stored in an outside memory means, such as a server, that is independent of the game apparatus 1, and may be downloaded into a memory, such as the game program memory 16, through a communication medium means, such as the Internet, by a reading program in the game program GPR.

After a predetermined operation for initialization (power-on operation, for example) in the game apparatus 1, the main controller 2 starts to read the game program GPR stored in the game program memory 16 and starts game procedures according to the program. When the player operates the controller 15 that is the input means for a predetermined game start, the main controller 2 starts various kinds of controls necessary for execution of the game according to routines of the game program GPR. The player is possible to freely move a player character PC in a virtual space VS according to the game program GPR through the operation of the controller 15.

Figure 2A:
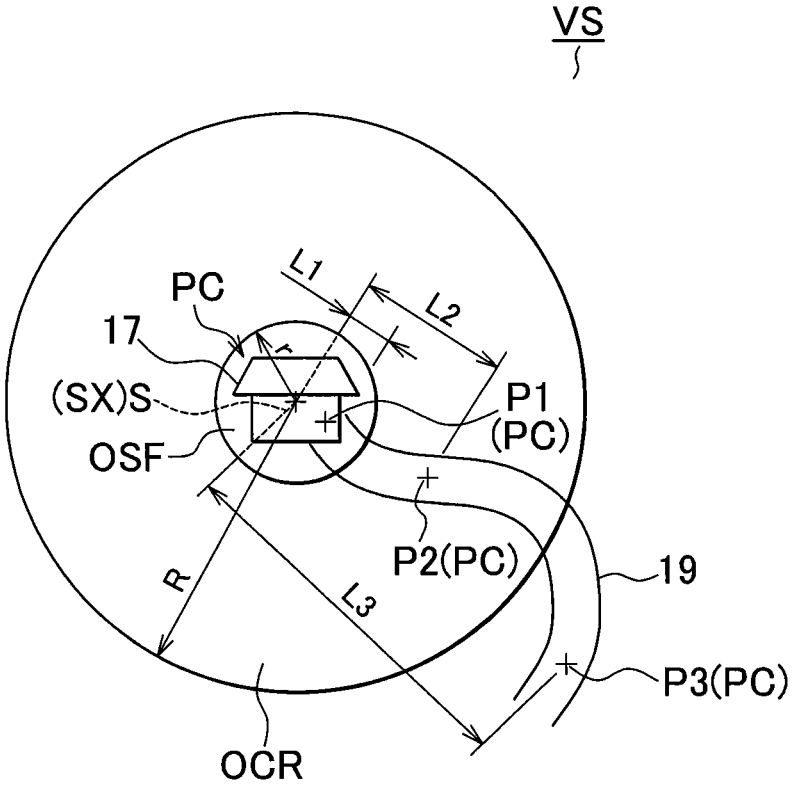
FIG. 2 is a typical view that shows an example of a relation of a distance between a sound field and a player character in a virtual space.
Figure 2B:
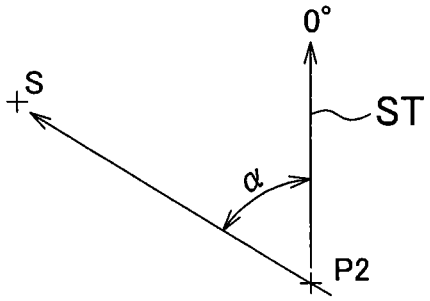

As shown in FIG. 2(*a*), for example, during the game the player character PC often approaches or goes away from the coordinate position (SV) where the sound source S is set in the virtual space VS formed in the memory space of the computer. Generally, for the sound source S sound data corresponding to the sound source S is set as the sound channels in the game program GPR, the number of which corresponds to the number of speakers comprising the sound field supposed by the game program GPR, and sound track data is respectively stored in each sound channel. In a case of FIG. 1, the game program GPR prepares four sound channels, a FR sound channel for the front right speaker 10A, a FL sound channel for the front left speaker 10B, a LR sound channel for the rear right speaker 10D and a LL sound channel for the rear left speaker 10C according to a surround system comprising the four speakers 10 forming the sound field for the sound source S of FIG. 2, and the sound track data to be outputted from each speaker is stored in each sound channel. In other words, a predetermined development angle according to each speaker arrangement is assigned by default to each sound channel that is set on the sound source S.

When such a scene is displayed on the display 13, the main controller 2 instructs the sound controller 6 and the sound field computer 7 to execute a control for a sound field based upon a sound field producing program SEP stored in the game program GPR. In a case of FIG. 2 (*a*), for example, an image PC created by rendering the virtual space VS formed in the memory space of the game apparatus 1 is displayed on the display 13, and the image is one of a building 17 and a way 19 extending from the building 17. The sound source S is located on a predetermined coordinate position SX in an object of the building 17 in the virtual space VS according to the game program GPR through the scenario proceeding controller 5. As already mentioned, four sound channels are set, corresponding to location positions of the respective speakers 10A, 10B, 10C and 10D, that is, the front right speaker, the front left speaker, the rear left speaker and the rear right speaker in the sound source S in the game program GPR, and the sound track data is stored in each sound channel.

Figure 3:
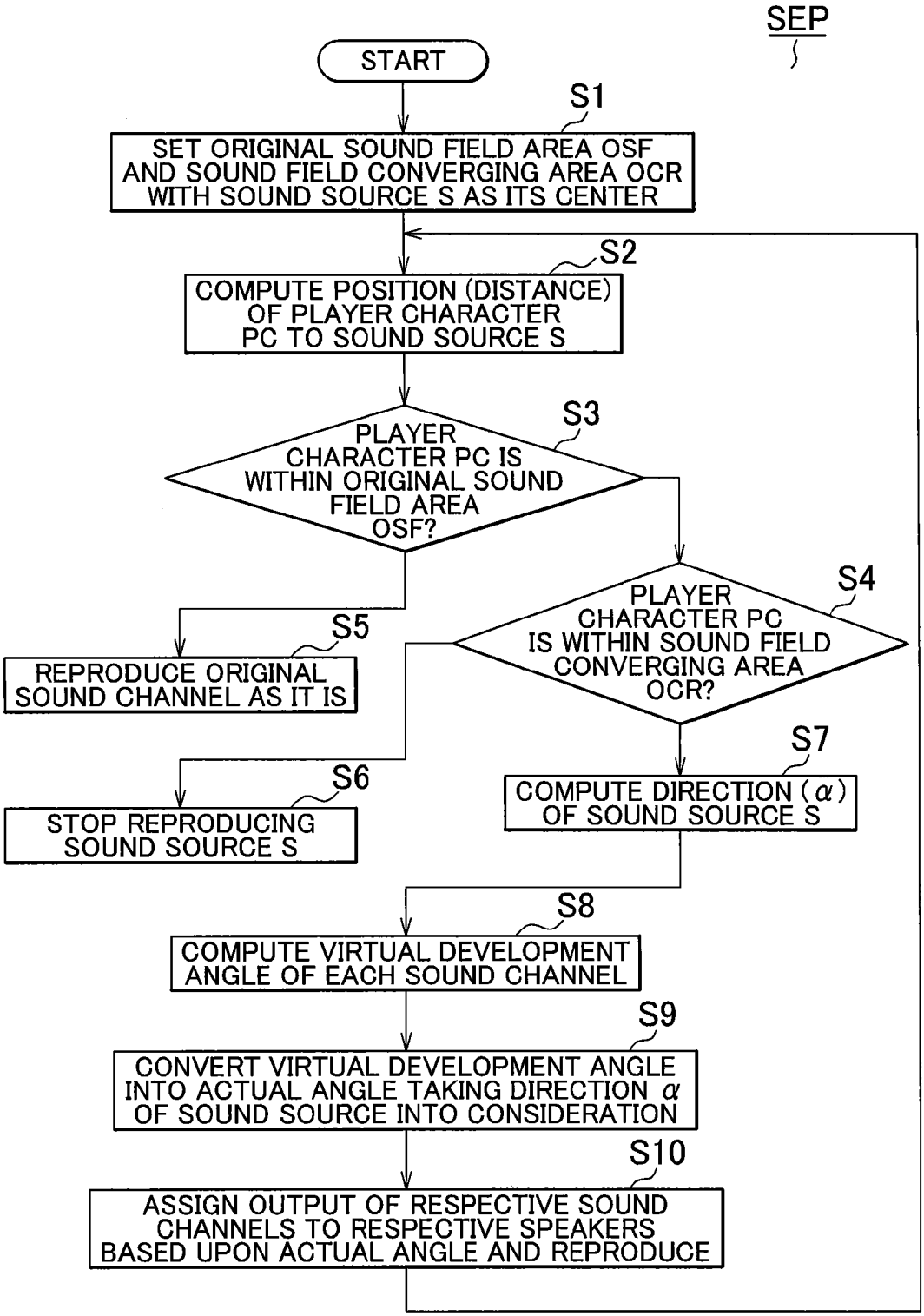
FIG. 3 is a flowchart that shows an example of a sound field creating program.

As shown in FIG. 3, the sound field producing program SEP sets an original sound field area OSF in the shape of a sphere having bounds of radius r as a first distance and a sound field converging area OCR in the shape of a sphere having bounds radius R as a second distance rather bigger than the radius r with the coordinate SX on which the sound source S is located in the virtual space VS of FIG. 2 as its center in Step S1. In a case where the player character PC does not widely move in a three dimensional direction in the virtual space VS, the original sound field area OSF and the sound field converging area OCR may be two-dimensionally set so as to simplify subsequent arithmetic processing. The sizes or the shapes of the original sound field area OSF and the sound field converging area OCR are optional, and it is not necessary that the original sound field area OSF is always included in the sound field converging area OCR, and both may be set, being adjacent to each other. Alternatively, the first distance r from the sound source S and the second distance R longer than the first distance may be set in the sound field producing program SEP without providing the areas, such as the original sound field area OSF and the sound field converging area OCR, and procedures mentioned hereinafter may be executed based upon only a result on the size obtained by comparing these r, R and a spaced distance L2 between the sound source S and the player character.

In the above-mentioned state, the main controller 2 instructs the sound field computer 7 to compute a position of the player character PC with respect to the sound source S (the spaced distance) based upon Step S2 of the sound field producing program SEP. Subsequently, the sound field producing program SEP enters Step S3, and the sound field computer 7 judges as to whether or not the position of the player character PC is within the distance r from the coordinate position where the sound source S is located, that is, whether or not the position of the player character PC is within the original sound field area OSF. If this original sound field area OSF is an area adjacent to the sound source S and the player character PC is within this area, the player character PC is at a position sufficiently adjacent to the sound source S. Then, it is desirable that the player character PC is able to hear sounds from the sound source S, three-dimensionally from his (her) periphery at such a position. If the player character PC is in the original sound field area OSF, the scenario proceeding controller 5 switches an image displayed on the display 13 into an image showing an inside of the building 17 or a position adjacent to its periphery by changing a view point of a virtual camera in the virtual space VS according to the game program GPR so as to produce such that three-dimensional hearing of sounds from the sound source S from the periphery of the player character PC is not unnatural.

In a case where it is judged in Step S3 that the player character PC is positioned at a position a spaced distance L1 apart from the coordinate position where the sound source S is located within the distance r therefrom, that is, in the original sound field area OSF as position P1 of FIG. 2, the main controller 2 enters Step S5, and instructs the sound controller 6 to reproduce two or more sound channels set on the sound source S to default speakers respectively set on these sound channels as they are. Receiving this instruction, the sound controller 6 reads sound track data of the four sound channels that are stored in data area of the game program GPR corresponding to the respective speakers 10A, 10B, 10C and 10D as the sound source S and outputs the read to the respective speakers 10A, 10B, 10C ad 10D (default speakers). Then, respective sound track data are reproduced from the four sound channels respectively assigned to the speakers from the respective speakers 10A, 10B, 10C and 10D that are supposed by default by the respective sound channels of the sound source S of the game program GPR, and the player 11 who is at a position almost equal distance away from the speakers 10A, 10B, 10C and 10D can hear sounds of the sound source S in a surround state where the sounds of the sound source S are heard from his (her) own periphery. For this reason, the player can obtain such a real feeling that the player is at a position of the player character PC who is near the sound source S.

In a case where the judgment in Step S3 is that the player character PC is not within the distance r from the coordinate position where the sound source S is located, that is, outside the original sound field area OSF, the main controller 2 instructs the sound field computer 7 to judge as to whether or not the player character PC is within the distance R from the coordinate position where the sound source S is located, that is, within the sound field converging area OCR according to Step S4 of the sound field producing program SEP. In a case where the judgment in Step S4 is that the player character PC is at a position P3 of FIG. 2, for example, and is outside the distance R from the coordinate position where the sound source S is located, that is, is outside the sound field converging area OCR, having spaced distance L3, the program enters step S6 of FIG. 3 and the main controller 2 instructs the sound controller 6 to stop the reproduction of the sound source S. That is, the game program GPR sets the area outside the sound field converging area OCR as an area where no sound is reached from the sound source S and the player character PC who is in the sound field converging area OCR can hear no sound of the sound source S. Then, driving of the respective speakers 10A, 10B, 10C and 10D through the sound controller 6 is stopped.

If the judgment of Step S5 is that the player character PC is at a position P2 in FIG. 2(*a*), for example, that is farther than the distance r from the coordinate position SX where the sound source S is located and closer than the distance R therefrom, that is, outside of the original sound field area OSF and within the sound field converging, area OCR having space distance L2 (assuming that the original sound field area OSF is not included in the sound field converging area OCR), the sound field producing program SEP proceeds to Step S7 and the main controller 2 instructs the sound field computer 7 to compute a direction $\alpha$ of the sound source S that is seen from a present position P2 of the player character PC. The direction a of the sound source S is obtained as an angle $\alpha$ to the base axis ST that is properly set in the virtual space VS as shown in FIG. 2(*b*), and various kind of such methods may be adopted. For example, an optional method, such as a direction vector with the position P2 as an origin, can be taken. If the virtual space VS is rendered in a direction where the player character PC faces through a virtual camera and its image is displayed on the display 13, an axis parallel to the direction in the virtual space VS that corresponds to the direction vertical to the display surface 13*a* of the display 13 as shown in FIG. 1 (that is, Z-axis direction of the virtual camera that renders the virtual space VS) is determined as the base axis. If so, the direction of the sound source S to the player character PC and the direction of the building 17 which is the direction of the sound source that the player sees on the display surface 13*a* (the building is an object on which the sound source S is located) can be corresponded to each other, so that control is possible increasing a feeling with reality.

Since the distance L2 between the present position P2 of the player character PC and the sound source S has already been computed, the main controller 2 instructs the sound field computer 7 to compute a virtual development angle of each sound channel, that is, the virtual development angle at a time of reproducing the sound track data of each sound channel of the sound source S, that is, the virtual angle at the time of reproducing the sound track data to a predetermined listening position in the sound field according to Step S8 of the sound field producing program SEP. Receiving this instruction, the sound field computer 7 computes the virtual development angle for each sound channel based upon Equation (1).

$$\text{Virtual development angle} = \text{Development angle of default} \times (1.0 - (L2 - r)/(R - r)) \quad (1)$$

If the distance L2 between the present position P2 of the player character PC and the sound source S is on a boundary of the original sound field area OSF of the radius r, the virtual development angle is the default development angle, and if the distance L2 is between the radius r and the radius R, that is, in the sound field converging area OCR, the virtual development angle converges on zero degree as the distance L2 approaches an outer boundary of the sound field converging area OCR (the radius R). Then, the bigger the spaced distance L2 between the player character PC and the sound source S is, the smaller the virtual development angle of each sound channel, and the sounds totally become to be monaural.

For example, in a case of front two channels, the default development angles in the game program GPR of right and left channels (speakers) are set as left 45° and right 45°. Then, A) if the position of the player character PC is within the original sound field area OSF, the virtual development angles are still default angles, left 45° and right 45°. B) if the position of the player character PC is at an intermediate position between the radius r of the original sound field area OSF and the radius R of the sound field converging area OCR, the virtual development angles are left 22.5° and right 22.5°. C) if the position of the player character PC is on the boundary of the radius R of the sound field converging area OCR, the virtual development angles are left 0° and right 0° Equation (1) is a simplified and typical one, so that the virtual development angle may be computed with a more complex equation.

In a case of the surround system that is comprised of the front and rear four speakers as shown in FIG. 1, the development angles of the front right and left channels are left 45° and right 45°, similar to the case of the two channels. As already mentioned, the default development angles of the rear right and left channels (speakers) are left 120° and right 120°. B') if the position of the player character PC is the immediate position between the radius r of the original sound field area OSF and the radius R of the sound field converging area OCR, the virtual development angles of the rear right and left channels are left 60° and right 60°. That is, the rear left and right channels moves forward and approaches the front left and right channels in such a state.

The case where the position of the player character PC is within the original sound field area OSF and the case where the position of the player character PC is on the boundary of the radius R of the sound field converging area OCR are similar to the two channels.

After thus computing the virtual development angle of each sound channel, the main controller 2 enters step S9 of the sound field producing program SEP, and instructs the sound field computer 7 to convert the virtual development angle computed in Step S8 into an actual angle, adding a direction (α) of the sound source computed in Step S7, that is, into the angle at the time when the sound track data of the sound channels is actually developed on the sound field. If the virtual development angles have been computed as left 22.5° and right 22.5° in the front left and right speakers and the direction (α) of the sound source S that was seen from the player character PC in Step S7 was left 45°, the actual angle of the front left speaker is converted into left 67.5° and the actual angle of the front right speaker is converted into left 22.5° by adding left 45° to these virtual development angles.

In addition, in a case of four channels, the actual angle of the real left speaker is converted into left 105° and the actual angle of the rear right speaker is converted into right 15° by adding left 45° to the virtual development angles obtained in B'), left 60° and right 60°.

After thus obtaining the actual angle for each speaker, the main controller 2 instructs the sound controller 6 to assign the sound track data of each sound channel to each speaker so as to correspond to the obtained real angles (to do a mixing process) based upon Step S10 of the sound field producing program SEP. Such a process is well known as a panning process of the sound track data to two or more speakers, so that its detailed explanation is not mentioned. In a case of two channels, for example, in the front left speaker for which the actual angle, left 67.5° was computed, the default development angle set by the game program GPR is 45°, so that further development on the left side is not possible and the sound track data for the front left speaker is outputted to the left speaker as it is. In the front right speaker for which the actual angle, left 22.5° was computed, the sound track data originally set for the right speaker is distributed to the right and left speakers 10A and 10B such that the sounds reproduced from the sound track data can be heard from left 22.5°. As the result, the sounds from the sound source S are outputted, having a directivity on a rather left hand of the player 4 of FIG. 1, and the sounds of the sound source S equally outputted from the right and left speakers 10A and 10B in the original sound field area OSF are reproduced, being moved on the rather left hand of FIG. 1 so as to correspond to the position of the player character PC who is somewhat away from the sound source S, so that reality increases.

Such effects are especially expressed in a case of the surround system comprising the front and rear speakers. That is, in a case of the surround system comprising the four speakers like FIG. 1, the sound track data corresponding to the respective sound channels are independently outputted from the four speakers in the original sound field area OSF, as mentioned before, and the player bodily feels a state of the player character PC that is just near the sound source S, being surrounded by the sounds outputted from the periphery. If the player character PC is within the sound field converging area OCR, in the front left speaker for which the actual angle, left 67.5° was computed, the sound track data of the sound channel corresponding to the left speaker is assigned between the front left speaker 10B and the rear left speaker 10C so as to hear the sounds from the direction of left 67.5° between the front left speaker 10B and the rear left speaker 10C. In the output of the front right speaker, the sound track data originally set for right speaker is distributed to the right and left speakers 10A and 10B so as to hear the sounds reproduced from the sound track data from left 22.5°, similar to the above-mentioned.

Furthermore, the sound track data of the sound channel corresponding to the rear left speaker 10C is distributed between the rear left speaker 10C and the front left speaker 10C so as to hear the sounds from the direction of left 105° between the front left speaker 10B and the rear left speaker 10C. Similarly, the sound track data of the sound channel corresponding to the rear right speaker is distributed between the front left speaker 10B and the front right speaker 10A so as to hear the sounds from the direction of right 15°. Such procedure is done since the direction of right 15° is between the front left speaker 10B and the front right speaker 10A. That is to say, no sound is outputted from the rear right speaker 10D.

If the player character PC is in the original sound field converging area OSF, sound channels are respectively outputted from the four speakers, thus the player 9 is surrounded by the sound field enclosing the sound source S and if the player character PC is moved to the position P2, no sound track data is outputted from one rear speaker 10D and four sound track data that is mixed is outputted from front right and left speakers 10A and 10B and the rear left speaker 10C only. And, the sound controller 6 distributes the respective sound track data so as to hear the respective sound track data from the directions where the actual angles are left 105°, left 67.5°, left 22.5° and right 15°, so that the sounds are heard, positioning the sound source S on a left forward hand of the player 11 as a whole. This corresponds to a positional relation between the position of the player character PC and the sound source S.

This procedures, Step S2 through S10 of the sound field producing program SEP are repeatedly executed until the player character PC goes out of the original sound field area OSF and goes out of the boundary of the sound field converging area OCR. Therefore, the closer to the boundary of the sound field converging area OCR the player character PC is, the closer to 0° the virtual development angle of each sound channel is. At the result, the sounds are controlled to gradually converge in the direction a of the sound source S in the virtual space VS, and the player 11 feels that the sounds are heard from the sound source S in a monaural state from the direction where the sound source S is positioned and is possible to have natural feelings as the player character PC separates from the sound source S.

The invention claimed is:

1. A game sound field creator in a game apparatus connected to speakers located at two or more positions, through which sound track data from a sound source having two or more sound channels that is located at predetermined positions in a virtual space formed in a memory space can be respectively outputted from the speakers in association with a position of a player character located in said memory space, said two or more sound channels being set corresponding to a position where each of said speakers is located, in said game apparatus, said player character can freely move in said virtual space by a player through an input means, said game sound field creator comprising:

a distance computer that computes a spaced distance between said sound source and said player character in said virtual space;

a direction computer that computes a direction of said sound source to said player character in said virtual space;

a distance judger that judges as to whether said spaced distance is a first distance or shorter, is a second distance or longer, or between the first distance and the second distance, wherein the second distance is greater than the first distance;

a first output means that respectively outputs sound track data of said two or more sound channels to said speakers located at positions corresponding to said two or more sound channels if said spaced distance is said first distance or shorter;

a second output means that stops output of said sound track data of said two or more sound channels if said spaced distance is said second distance or longer;

a virtual development angle computer that computes a virtual development angle of each of said two or more sound channels corresponding to said spaced distance so as to make said virtual development angle smaller, as said spaced distance is made longer, between a default development angle of said first distance and zero (0) degree of said second distance if said spaced distance is between said first distance and said second distance;

an actual angle converter that converts said obtained virtual development angle of said each sound channel into an actual angle adding a direction of said sound source; and output assignment reproducer that assigns said sound track data of each sound channel to one or more said speakers based upon said converted actual angle of said each sound channel and reproduces the assigned data.

2. The game sound field creator according to claim 1, wherein said speakers located at two or more positioned are a front right speaker, a front left speaker, and said sound track data of said sound source are set for two channels in association with said front right speaker and said front left speaker.

3. The game sound field creator according to claim 1, wherein said speakers located at two or more positions are the front right speaker, the front left speaker, a rear right speaker and a rear left speaker, and said sound track data of said sound source are set for four channels in association with said front right speaker, said front left speaker, said rear right speaker and said rear left speaker.

4. The game sound field creator according to claim 1, wherein said distance judger has an area setter that sets an original sound field area where a radius from said sound source is set to be a first distance and a sound field converging area where a radius from said sound source is set to be a second distance, and said distance judger judges whether said spaced distance is the first distance or shorter, the second distance longer than the first distance or longer, or between the first distance and the second distance by whether said player character is in said original sound field area or said sound field converging area.

5. The game sound field creator in the game apparatus according to claim 4, wherein said original sound field area is located inside said sound field converging area.

* * * * *